US005374101A

United States Patent [19]

Wiecek

[11] Patent Number: 5,374,101

[45] Date of Patent: Dec. 20, 1994

[54] THREE-WAY RECLINING CHAIR

[75] Inventor: Glenn N. Wiecek, Shelbyville, Ky.

[73] Assignee: L&P Property Management Company, Inc., Chicago, Ill.

[21] Appl. No.: 921,555

[22] Filed: Jul. 29, 1992

[51] Int. Cl.[5] ..... A47C 1/02

[52] U.S. Cl. ..... 297/85; 297/75

[58] Field of Search ..... 297/84, 85, 89, 69, 297/75

[56] References Cited

U.S. PATENT DOCUMENTS

| | | | |
|---|---|---|---|
| 3,056,629 | 10/1962 | Fletcher | 297/84 |
| 3,100,668 | 8/1963 | Rogers et al. . | |
| 3,279,847 | 10/1966 | Re | 297/89 |
| 3,357,739 | 12/1967 | Knabusch et al. . | |
| 3,370,884 | 2/1968 | Rogers | 297/84 |
| 3,558,185 | 1/1971 | Mizelle | 297/84 |
| 3,572,823 | 3/1971 | Hampton . | |
| 3,637,255 | 6/1972 | Re | 297/85 |
| 3,652,125 | 3/1972 | Rogers, Jr. . | |
| 3,865,432 | 2/1975 | Rogers, Jr. et al. . | |
| 4,306,746 | 12/1981 | Crum . | |
| 4,319,780 | 3/1982 | Rogers, Jr. . | |
| 4,337,977 | 7/1982 | Rogers, Jr. et al. . | |
| 4,350,387 | 9/1982 | Rogers | 297/85 |
| 4,544,201 | 10/1985 | Rogers, Jr. . | |
| 4,863,215 | 9/1989 | Crum . | |
| 5,013,084 | 5/1991 | May | 247/85 |

OTHER PUBLICATIONS

Drawings (FIGS. 1–3) illustrating a prior art linkage assembly for a three-way reclining chair manufactured by the assignee of the present invention, i.e., L&P, Model No. 2E 8338.

*Primary Examiner*—Flemming Saether

*Attorney, Agent, or Firm*—Wood, Herron & Evans

[57] ABSTRACT

A three-way reclining chair having a stationary base and a relatively movable seat, backrest, and footrest, with a linkage assembly mounted on each side of the recliner chair, having a seat linkage, a backrest linkage and a footrest linkage. A stop mechanism located within at least one of the backrest linkages prevents the seat from moving directly from a normal seating position to a reclined position while the footrest is in a fully retracted closed position. The stop mechanism also prevents the backrest from moving out of an upright position while the footrest is in the fully retracted closed position and returns the backrest to an upright seating position if the footrest is moved from a fully extended open position to the fully retracted closed position when the backrest is reclined. A tension spring interconnects the footrest linkage and seat linkage to positively bias the footrest to remain in the fully retracted closed position and the fully extended open position. The strength of the spring can be increased until the footrest is positively biased with sufficient force to remain in the fully retracted closed position when the chair is moved by pulling rearwardly on the backrest. The spring can also be oriented to provide a positive bias to assist in the moving of the footrest from a partially extended position to the fully extended open position. Because the stop mechanism is located in the backrest linkage, the seat section of the present three-way reclining chair can be made thinner than previous three-way reclining chairs.

21 Claims, 2 Drawing Sheets

THREE-WAY RECLINING CHAIR

FIELD OF THE INVENTION

This invention relates to three-way reclining chairs, and more particularly, to improvements in such chairs.

BACKGROUND OF THE INVENTION

Three-way reclining chairs are well known to the prior art. Such chairs generally include a stationary base, a relatively moveable seat, backrest, and footrest. A linkage mechanism for interconnecting the base, seat, backrest and footrest typically includes a linkage assembly mounted on each side of such chairs, with each linkage assembly having a seat linkage, backrest linkage and footrest linkage. The seat is mounted to the base by the seat linkages for movement relative to the base between a normal seating position, an intermediate or TV position, and a full-recline position. The backrest is mounted to the backrest linkages for movement relative to the seat between a generally upright position and a reclining position where the backrest extends at an incline relative to the seat. The footrest linkages mount the footrest for movement relative to the seat between a fully retracted position adjacent the seat and a fully extended position projected forwardly from the seat.

Traditionally, such recliner chairs have been specialty furniture items which were primarily designed for comfort, not styling. In many cases, they occupied special status in the home as they did not conform to the existing styling of other furniture items in the home. However, the evolution of reclining chair styling in home interiors has progressed to the point where today it is of major concern. Thus, in many instances, it is desirable for such recliner chairs to look more like a regular chair, with a shallow front-to-back and thin seat and high (i.e., more visible) legs. However, with the seat in the normal seating position and the footrest in the fully retracted position, three-way reclining chairs typically have bulkier seat sections than standard chairs in order to accommodate and hide the linkage mechanism. In addition, the legs of such reclining chairs are kept short to prevent giving the chair an overall high profile. A lower profile makes it easier for a person to get in and out of the chair. Therefore, there is a need for three-way reclining chairs with a linkage mechanism which allows the chair to have a shallower and thinner seat section and longer, more visible legs while still maintaining an overall low profile.

Prior reclining chairs have used tension springs in their linkage mechanism in an effort to maintain the footrest in the fully extended position or in the fully retracted position, when the footrest has been so positioned by the chair's user. However, when the chair is designed for the footrest to be manually extended or manually retracted, the strength of the tension spring can determine whether or not a customer is satisfied with the chair. If the spring tension is too great, extending or retracting of the footrest may prove difficult, particularly with respect to extending of the footrest since the user's weight can be more easily applied to help retract the footrest. While reducing the spring tension may solve this problem, this solution has its own problems. With a light spring tension, when the chair is moved by pulling rearwardly on the backrest, the footrest is more likely to extend, making further movement of the chair cumbersome. In addition, the footrest is more likely to unintentionally retract from the fully extended position due to the reduced resistance of the spring.

Therefore, it is desirable for such chairs to use tension springs with high strength, but to also include some way of assisting the user in moving the footrest, particularly in extending the footrest. One way of assisting the actuation of the footrest linkages has been with a handle actuated footrest assembly, such as that disclosed in U.S. Pat. No. 4,113,305 to Hampton, which is assigned to the assignee of the present invention. However, the recliner chair disclosed in this Hampton patent still suffers from a relatively bulky seat section and includes a handle located externally on the side of the chair which also detracts from the aesthetic qualities sought by the present invention.

SUMMARY OF THE INVENTION

It is, therefore, among the objectives of this invention to provide a three-way reclining chair having a general appearance more like that of a standard, non-reclining chair. More particularly, it is an objective to provide such a reclining chair which has higher and more visible legs with a shallower and thinner seat section while still maintaining a low profile.

It is another objective of this invention to provide such a reclining chair which provides a spring bias for positively maintaining the footrest in both the fully extended and fully retracted positions, while also assisting the user in moving the footrest to the fully extended position.

An additional objective of this invention is to provide such a reclining chair which can be moved by pulling rearwardly on the backrest without the footrest being likely to extend.

These objectives are obtained by providing a three-way reclining chair comprising a stationary base and a relatively moveable seat, backrest, and footrest. A linkage mechanism for interconnecting the base, seat, backrest and footrest includes a linkage assembly mounted on each side of the recliner chair, with each linkage assembly having a seat linkage, a backrest linkage and a footrest linkage. The seat linkages mount the seat relative to the base for movement between a normal seating position, a TV or intermediate position, and a raised full recline position. The backrest linkages mount the backrest for movement relative to the seat between a generally upright seating position and a full recline position where the backrest extends at an incline relative to the seat. The footrest linkages mount the footrest for movement between a fully retracted closed position adjacent the seat and a fully extended open position projected forwardly from the seat.

A stop mechanism located within at least one and preferably each of the backrest linkages prevents the seat from moving directly from the normal seating position to a reclined position while the footrest is in the fully retracted closed position. The stop mechanism in the present three-way reclining chair also prevents the backrest from moving out of an upright position while the footrest is in the fully retracted closed position and returns the backrest to the upright seating position if the footrest is moved from the fully extended open position to the fully retracted closed position when the backrest is reclined.

A tension spring is interconnected between the footrest linkage and seat linkage to positively bias the footrest to remain in the fully retracted closed position and in the fully extended open position, while still allowing the footrest to be moved between the two positions by overcoming the spring's biasing force. The strength of the spring can be increased until the footrest is positively biased with sufficient force to remain in the fully retracted closed position when the chair is moved by pulling rearwardly on the backrest. To assist a user who wishes to overcome this strong spring force and extend the footrest, the spring can be oriented to provide a positive overcenter bias to assist the footrest in moving from a partially extended position to the fully extended open position.

In the preferred embodiment of this invention, the two linkage assemblies mounted on either side of the reclining chair are mirror images of each other. Therefore, only one linkage assembly will be described hereafter. The seat linkage includes a seat link mounted to the seat. The backrest linkage includes a backrest link mounting the backrest which is pivotally connected to the seat link and operatively connected to the base by a backrest control link which is pivotally connected between the base and the backrest link. The stop mechanism includes a pin on the backrest link engageable with a stop surface on the backrest control link.

One prior three-way reclining chair manufactured by the assignee of this invention, Model No. 8338, uses a sequencing link between the seat linkage and the footrest linkage as a stop mechanism to prevent the seat from moving directly from the normal or upright seating position to a reclined position while the footrest is in the fully retracted closed position. One reason the seat section of the present three-way reclining chair can be made thinner than such prior chairs is because its stop mechanism is in the backrest linkage. In addition, while the sequencing link used in this prior reclining chair does prevent the seat from moving as described above, if its footrest is moved from its fully extended position to its fully retracted position when the backrest is reclined, its linkage mechanism may lock up.

The preferred structure for enabling the tension spring to operate as described above includes a seat linkage assembly having a base link and a first seat support link with one end operatively connected with the base link and its other end operatively connected with the seat link by means of a front seat mounting link which is generally bell crank shaped with an actuating arm extending forwardly from the front seat mounting link. The footrest linkage includes a scissors linkage having a footrest operating link. The actuating arm of the front seat mounting link is pivotally connected to one end of the footrest operating link. The tension spring is a coil spring having one end connected to an arm projected upwardly from the other end of the first seat support link and its other end connected to the footrest operating link, adjacent the pivotal connection between the actuating arm and the footrest operating link.

BRIEF DESCRIPTION OF THE DRAWINGS

Other objectives and advantages of this invention will be more apparent from the following detailed description taken in conjunction with the drawings in which.

DETAILED DESCRIPTION OF THE PRESENT INVENTION

Figure 1:
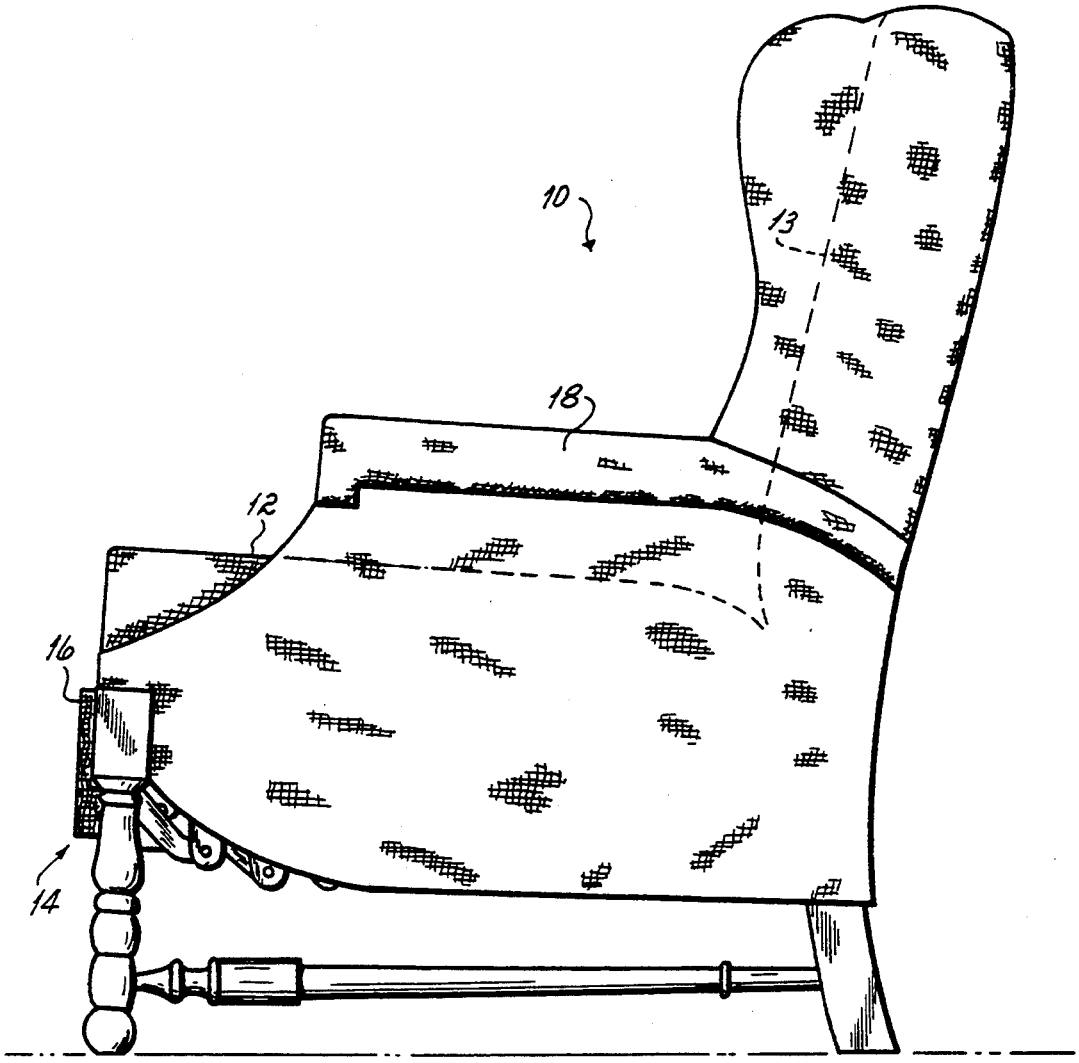
FIG. 1 is a side view of a three-way reclining chair according to this invention.

Referring to FIG. 1, a three-way reclining chair generally designated 10 embodying the present invention is shown in a normal seating position. The chair 10 includes a stationary base 11 having armrests 18 fixedly attaching thereto, a moveable seat generally designated 12, a moveable backrest generally designated 13, and a moveable footrest generally designated as 14 having a first and second footrest member 15, 16. The chair seat 12 and backrest 13 are capable of movement between the normal seating position (see FIG. 2), a TV or intermediate position (see FIG. 3), and a fully reclined position (see FIG. 4).

When the chair 10 is in the normal seating position, the seat 12 is in a normal seating position with a slight angle of recline towards its rear end, the backrest 13 is in a generally upright seating position, and the footrest 14 is in a fully retracted closed position adjacent the seat 12, with the first footrest member 15 underneath and the second footrest member 16 in front of the seat 12. When the chair 10 is in the TV position, the seat 12 is in a rearwardly shifted TV or intermediate position with an increased angle of recline, the backrest remains in a generally upright seating position and the footrest is in a fully extended open position projected forwardly from the seat 12, with member 15 extending in front of member 16. When the chair 10 is in the fully reclined position, the seat 12 is in a raised full recline position, the backrest 13 is in a full recline position where the backrest 13 extends at an incline relative to the seat 12 and the footrest 14 remains in the fully extended open position projected forwardly from the seat 12. The chair 10 incorporates a novel linkage mechanism according to this invention to accomplish this movement.

The linkage mechanism comprises two substantially identical mechanisms or linkage assemblies 17 located on opposite sides of the chair 10 and interconnected by appropriate cross pieces or cross bars (not shown). Since, in its preferred form, the two linkage assemblies are substantially identical and mirror images of each other, only one of the linkage assemblies 17 is illustrated and described in detail hereafter for purposes of simplification.

The linkage assembly 17 comprises a seat linkage 20 mounting the seat 12 for movement relative to the base 11 between the normal seating, rearwardly shifted TV, and raised full recline positions; a backrest linkage 21 mounting the backrest 13 for movement relative to the seat 12 between the generally upright seating and full recline positions; and a footrest linkage 22 mounting the footrest 14 for movement between the fully retracted and fully extended open positions.

The seat linkage 20 includes a seat link 24 mounted to the seat 12 and a base link 25 mounted to the base 11. The seat link 24 is generally bell crank shaped with an actuating arm 26 projecting upwardly from the rear end of the seat link 24. A scissors linkage 28 operatively connects the base link 25 to the seat link 24. The scissors linkage 28 comprises a first and second seat support link 30, 31 pivotally connected intermediate their ends by pivot connection 33. The first seat support link 30 has one end pivotally connected near the rear of the base link 25 by pivot connection 34 and its other end operatively connected with the seat link 24 by means of a front seat mounting link 36 which is generally bell crank shaped with a support arm 37 and an actuating arm 38. The front seat mounting link 36 is pivotally connected, intermediate its arms 37, 38 to the other end of the first seat support link 30 by pivot connection 40. The end of the support arm 37 of the front seat mounting link 36 is pivotally connected near the front end of the seat link 24 by pivot connection 42. The end of the actuating arm 38 of the front seat mounting link 36 is operatively connected with the footrest 14. The first seat support link 30 has a lever arm 44 projecting upwardly from its other end, preferably at an obtuse angle from the balance of the first seat support link 30. A stop pin 46 extends from the first seat support link 30 near its other end and is engageable with a stop surface 47 at the forward end of the base link 25. When the chair 10 is in the normal seating and TV positions, the stop pin 46 rests on top of the stop surface 47. When the chair 10 is in the fully reclined position, the pin 46 is above and does not contact surface 47.

The second seat support link 31 has one end pivotally connected near the front end of the base link 25 by pivot connection 50 and its other end operatively connected with the seat link 24 by means of a rear seat mounting link 52. The rear seat mounting link 52 is generally bell crank shaped with one end pivotally connected to the other end of the second seat support link 31 by pivot connection 54 and its other end pivotally connected to the rear end of the seat link 24 by a pivot connection 55. The rear seat mounting link 52 also has a stop surface 58 intermediate its ends engageable with a stop pin 59 extending from the seat link 24 near its rear end. When the chair 10 is in the normal seating position, the stop pin 59 and stop surface 58 are not engaged, i.e., not in contact. The stop pin 59 is located above and contacts the stop surface 58 when the chair 10 is in the TV and fully reclined positions. The second seat support link 31 has a sequence control pin 62 extending therefrom, intermediate its one end and the pivot connection 33, moveable within a sequence control slot 64 formed in the base link 25 intermediate its ends. The sequence control pin 62 rests at the bottom of the sequence control slot 64 when the chair 10 is in the normal seating and TV position. The pin 62 contacts the top of the slot 64 when the chair 10 is in the fully reclined position.

The backrest linkage 21 includes a backrest link 66 which mounts the backrest 13 and operatively connects the backrest 13 with the balance of the chair 10. The backrest link 66 is generally bell crank shaped and operatively connected to the base link 25 by a backrest control link 67. One end of the backrest control link 67 is pivotally connected to the backrest link 66 intermediate its ends by pivot connection 69. The other end of backrest control link 67 has a rearwardly projecting nose portion 72 which is pivotally connected to the rearward end of the base link 25 by a pivot connection 73. The backrest link 66 has a forwardly projecting lever arm 75 with its end pivotally connected to the end of the actuating arm 26 of the seat link 24 by a pivot connection 76.

A first stop pin 78 extends from the lever arm 75 of the backrest link 66 forward of pivot connection 69 for engagement with a stop surface on the underside of a forwardly projecting nose portion 81 at the one end of the backrest control link 67. A second stop pin 83 extends from the lever arm 75 of the backrest link 66 rearward of pivot connection 76 for engagement with a stop surface on the underside of a rearwardly projecting nose portion 84 at the end of the actuating arm 26 of the seat link 24. When the chair 10 is in its normal seating position, with the seat 12 in the normal seating position and the footrest 14 in the fully retracted closed position, both stop pins 78, 83 and nose portions 81, 84 are respectively in contact with each other (see FIG. 2). When the chair 10 is in the TV position, with the seat 12 in the rearwardly shifted TV position and the backrest 13 remaining in the generally upright seating position, only the second stop pin 83 and nose portion 84 are contacting. When the chair 10 is in the fully reclined position, with the seat 12 raised and the backrest inclined, neither pin 78, 81 is in contact with its respective nose portion 81, 84.

The footrest linkage 22 includes a first and second footrest link 87, 88 mounting the first and second footrest members 15, 16 of the footrest 14, respectively. The first footrest link 87 is pivotally connected near its rear end to a positioning flange 94 on the front end of the second footrest link 88 by a pivot connection 95. A double scissors linkage 97 operatively connects the footrest links 87, 88 with the seat linkage 20. The double scissors linkage 97 comprises a first scissors linkage 100 and a second scissors linkage 101. The first scissors linkage 100 has a second footrest actuating link 104 and a first crosslink 105 which are pivotally connected intermediate their ends by pivot connection 106. The second scissors linkage 101 has a footrest operating link 109 and a bell crank shaped second cross link 110 which are pivotally connected intermediate their ends by pivot connection 111.

One end of the second footrest actuating link 104 is pivotally connected to the rear end of the second footrest link 88 by pivot connection 114. The second footrest actuating link 104 is also operatively connected to the first footrest link 87 by a first footrest actuating link 116. The actuating link 116 has one end pivotally connected to the rear end of the first footrest link 87 by pivot connection 117 and its other end pivotally connected to the second footrest actuating link 104 intermediate its one end and pivot connection 106 by pivot connection 120.

The first cross link 105 is operatively connected to the second footrest link 88 by a bell crank shaped footrest positioning link 122. The footrest positioning link 122 has one end pivotally connected to the second footrest link 88 intermediate its ends by pivot connection 123 and its other end pivotally connected to one end of the first cross link 105 by pivot connection 125. The other end of the first cross link 105 is pivotally connected to one end of the footrest operating link 109 by pivot connection 127, and the other end of the second footrest actuating link 104 is pivotally connected to one end of the second cross link 110 by pivot connection 128. The other end of the footrest operating link 109 is pivotally connected to the end of the actuating arm 38 of the front seat mounting link 36 by pivot connection 130. The other end of the second cross link 110 is pivotally connected to the forward end of the seat link 24 by pivot connection 132.

In order to limit the retraction of the footrest linkage 22, a retraction stop pin 134 is fixed to the second cross link 110 between the pivot connections 111 and 128 to engage a stop surface 135 along the second footrest actuating link 104 between the pivot connections 106 and 128. The stop pin 134 contacts the stop surface 135 when the chair 10 is in the normal seating position and the footrest 14 is in the fully retracted closed position adjacent the bottom of the seat 12. The footrest linkage 22 is interconnected to the seat linkage 20 by a tension coil spring 138 having one end anchored to a pin 139 fixed to the footrest operating link 109 adjacent pivot connection 130 and its other end connected to another pin 140 fixed to the end of the lever arm 44 of the first seat support link 30.

Figure 2:
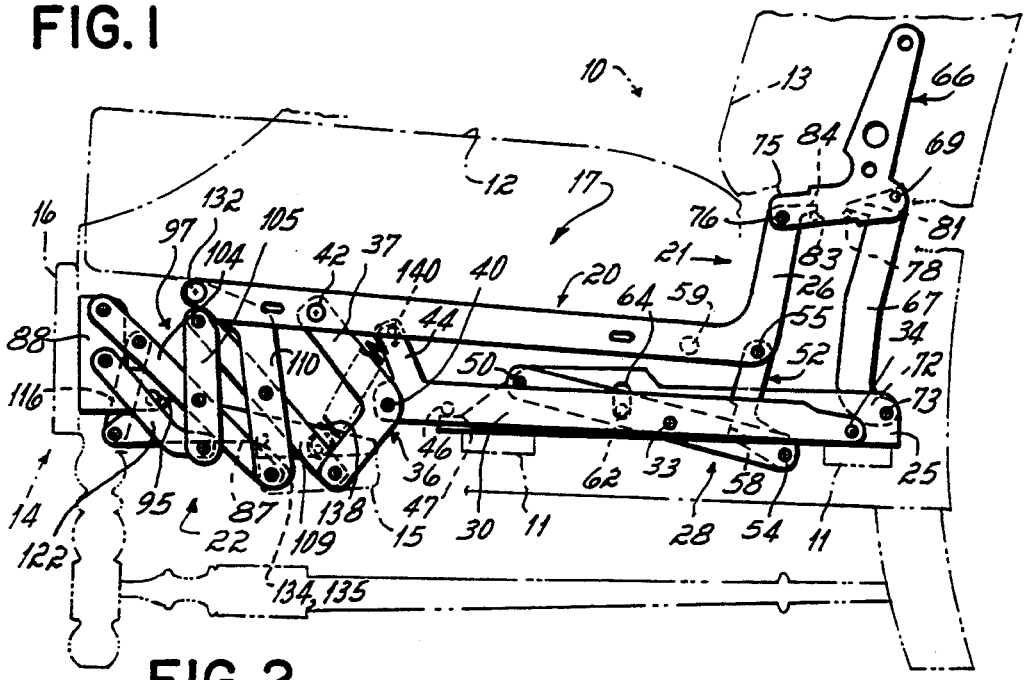
FIG. 2 is a side view of the chair of FIG. 1 in phantom showing one of the linkage assemblies of this invention in a normal seating position.
Figure 5:
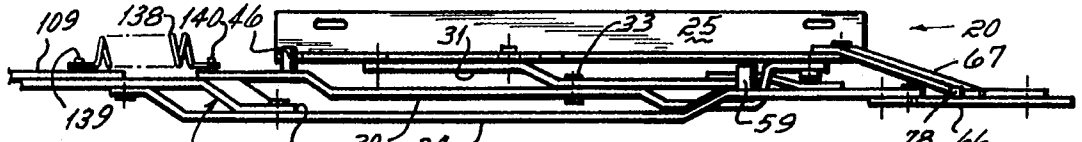
FIG. 5 is a partial top view of the linkage assembly of FIG. 3.

The linkage mechanism is manually operated by a user to move the chair 10 between its various positions. Assuming the chair 10 is in the normal seating position, as illustrated in FIGS. 1 and 2, the spring 138 provides a positive spring bias to the footrest linkage 22 to maintain the footrest 14 in the fully retracted closed position and maintain the engagement of the stop pin 134 on the second cross link 110 of the second scissors linkage 101 with the stop surface 135 on the second footrest actuating link 104 of the first scissors linkage 100. With the chair 10 so maintained in the normal seating position by spring 138, all movement of the backrest link 66 and backrest 13 is prevented by a combination of the stop pins 78, 83 being engaged with the nose portions 81, 84, respectively, as previously described. In particular, engagement of the first stop pin 78 on the lever arm 75 of the backrest link 66 with the nose portion 81 on the backrest control link 67 stops the backrest link 66 from rotating clockwise around pivot connection 69 and prevents the backrest 13 from moving out of the generally upright position to a recline position where the backrest 13 extends at an incline relative to the seat 12. As will become clearer later on in this discussion, the engagement of stop pin 78 and nose portion 81 also prevents the seat link 24 from moving upwardly with respect to the base link 25. The seat link 24 is prevented from moving downwardly by a combination of the stop pin 46 on the first seat support link 30 engaging the stop surface 47 on the forward end of the base link 25, and the sequence control pin 62 on the second seat support link 31 engaging the bottom of the sequence control slot 64 in the base link 25, as previously described.

With a user seated in the chair 10, the user can manually operate the chair 10 from the normal upright seating position to the TV position by exerting rearward pushing back pressure on the armrests 18 until the positive spring bias provided by the spring 138 in maintaining the footrest 14 in the fully retracted closed position is overcome. This rearwardly applied pressure to the armrests 18 is transmitted to the seat link 24 and backrest link 66 causing the seat link 24 and backrest link 66 to move rearwardly, while generally maintaining the same upright orientation. As will become apparent from the description below, the positive bias provided by the spring 138 to maintain the footrest in the fully retracted closed position must be overcome by this rearwardly applied pressure before the backrest link 66 will move rearwardly. As the backrest link 66 moves rearwardly, the backrest control link 67 rotates clockwise around pivot connection 73 with respect to the base link 25 and clockwise around pivot connection 69 with respect to the backrest link 66. As the backrest control link 67 rotates clockwise around pivot connection 69, its nose portion 81 disengages or separates from the stop pin 78 on the lever arm 75 of the backrest link 66. Initially, the backrest control link 67 is in a generally upright position. However, when it begins to rotate clockwise, the backrest control link 67 begins to incline rearwardly, forming an obtuse angle with the base link 25. The clockwise rotation of the backrest control link 67 causes the backrest link 66 to drop downwardly as the backrest link 66 moves rearwardly. With the backrest link 66 pivotally connected to the seat link 24 by pivot connection 76, the seat link 24 is pulled rearwardly along with the backrest link 66. With the seat link 24 pivotally connected to the front and rear seat mounting links 36, 52 by pivot connections 42, 55, respectively, as the seat link 24 moves rearwardly, the front and rear seat mounting links 36, 52 rotate clockwise about their pivot connections 40, 54 to the first and second seat support links 30, 31, respectively. With the rear seat mounting link 52 being bell crank shaped, the rear end of the seat link 24 drops downwardly causing the recline angle of the seat 12 to increase as the seat link 24 moves rearwardly.

The rearward movement of the seat link 24 and the clockwise rotation of the front seat mounting link 36 caused by the rearwardly applied pressure to the backrest 13 results in the extension of the footrest linkage 22 and movement of the footrest 14 out of the fully retracted closed position to an extended position. As the front seat mounting link 36 rotates clockwise about pivot connection 40, the end of its actuating arm 38 also rotates clockwise, moving upward. With the end of the actuating arm 38 of the front seat mounting link 36 being pivotally connected to the other end of the footrest operating link 109 by pivot connection 130 and the forward end of the seat link 24 being pivotally connected to the other end of the second crosslink 110 by pivot connection 132, the rearward movement of the seat link 24 and the clockwise rotation of the actuating arm 38 actuates both scissors linkages 100, 101 into a scissors action causing the double scissors linkage 97 to extend forwardly.

As the double scissors linkage 97 extends forwardly, the stop pin 134 and stop surface 135 disengage. With the scissors action of the first scissors linkage 100, the first crosslink 105 rotates clockwise around pivot connection 106 with respect to second footrest actuating link 104. The clockwise rotation of the first crosslink 105 exerts a force which is transmitted to the second footrest link 88 through footrest positioning link 122, causing the second footrest link 88 to rotate clockwise around pivot connection 114 and moving the second footrest member 16 out of a generally upright position. The clockwise rotation of the second footrest link 88, in turn, exerts a force which is transmitted through its positioning flange 94 to the first footrest link 87 at pivot connection 95. With the rear end of the first footrest link 87 being maintained at a fixed distance from the second footrest actuating link 104 by the first footrest actuating link 116 and the flange 94 being pivotally connected to the first footrest link 87 intermediate its ends, the clockwise rotation of the second footrest link 88 around pivot connection 114 causes the first footrest link 87 to rotate clockwise around pivot connection 95 out from underneath the seat link 24 and the first footrest member 15 out from underneath the seat 12.

Figure 3:
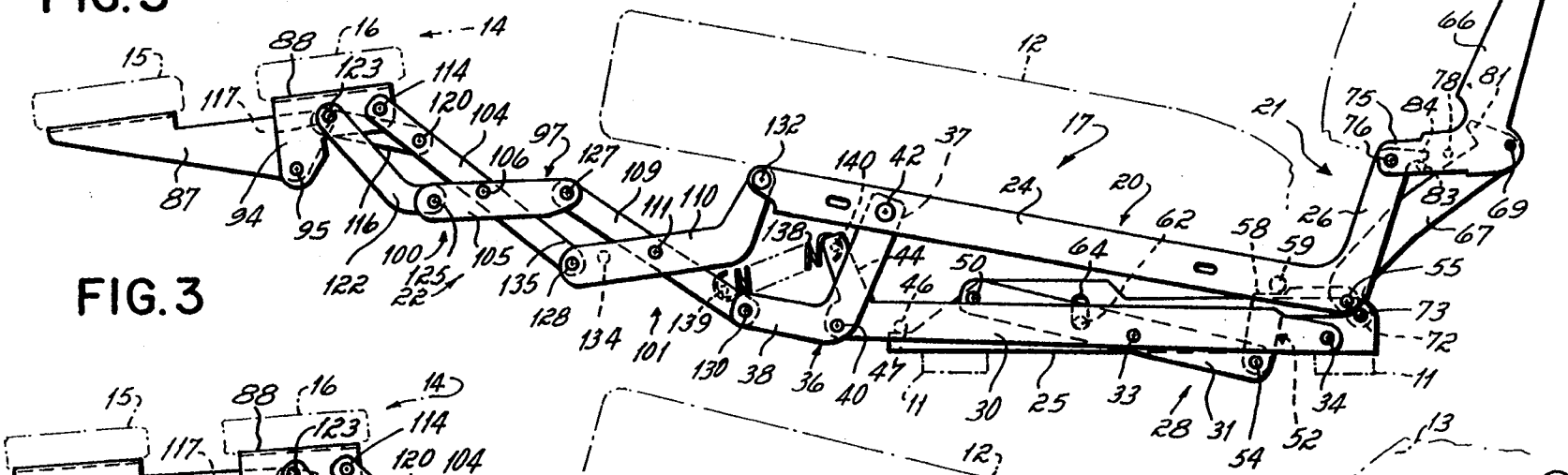
FIG. 3 is a side view of the linkage assembly of FIG. 2 in the TV position.

Eventually, the rearward movement of the seat link 24 and the clockwise rotation of the seat mounting links 37, 52 will be halted and the chair 10 will reach the TV position when the stop pin 59 engages the stop surface 58 on the rear seat mounting link 52, as previously described. With the chair in the TV position, as shown in FIG. 3, the footrest linkage 22 is fully extended forwardly from the seat linkage 20, with the footrest members 15, 16 being generally coplanar and the first member 15 being forward of the second member 16. In addition, the seat link 24 has shifted rearwardly and its rear end dropped downwardly with respect to the base link 25, and the backrest link 66 has moved rearwardly and dropped downward with respect to the base link 25 while remaining in a generally upright position with respect to the seat link 24.

The spring 138 also provides a spring bias to aid the user in actuating the footrest linkage 22 to move the footrest 14 from a partially extended position, with the first footrest link 87 rotated clockwise to a point where the first footrest member 15 has reached a generally upright position, to the fully extended open position shown in FIG. 3. With the chair 10 in the TV position, the spring 138 provides a positive spring bias to maintain the footrest linkage 22 fully extended and the footrest 14 in the fully extended open position, thereby helping to prevent unintended retraction of the footrest 14.

If it is desired to return the chair 10 from the TV position to the normal seating position, the user applies sufficient downward and rearward foot pressure on the footrest 14 to overcome the positive bias provided by spring 138 in maintaining the TV position, thereby causing the above sequence of linkage movements to be reversed.

Figure 4:
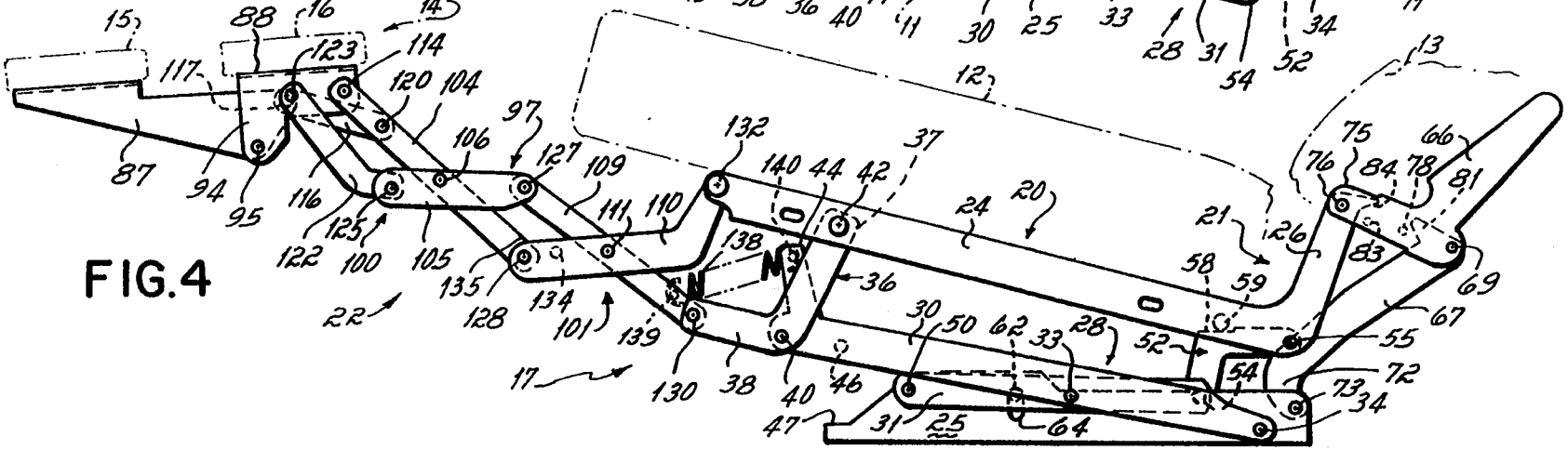
FIG. 4 is a side view of the linkage assembly of FIG. 2 in a fully reclined positioned.

If, on the other hand, it is desired to move the chair 10 from the TV position to the fully reclined position, the user merely applies rearward back pressure on the backrest 13. With the stop pin 59 and stop surface 58 being engaged as previously described, rearward movement of backrest link 66 and clockwise rotation of backrest control link 67 with respect to base link 25 is prevented. With stop pin 78 and nose portion 81 being separated, the additional rearward back pressure causes the backrest link 66 to rotate clockwise around pivot connection 69 and the backrest 13 to extend rearwardly at an incline relative to the seat 12. As the backrest link 66 rotates, the stop pin 78 moves toward the nose portion 81, reducing the distance between them. With its lever arm 75 pivotally connected to the seat link 24 at pivot connection 76, this clockwise rotation of backrest link 66 exerts a force which pulls the seat link 24 upward from the base link 25. This upward pulling force exerted on the seat link 24 is transmitted through the seat mounting links 37, 52 to the seat support links 30, 31 by pivot connections 40, 54, respectively, causing the first seat support link 30 to rotate clockwise at its one end around pivot connection 34 with respect to the base link 25. With the first seat support link 30 connected to the second seat support link 31 at pivot connection 33, this clockwise rotation of the first seat support link 30 causes the second seat support link 31 to rotate counterclockwise at its one end around pivot connection 50 with respect to the base link 25. As the second seat support link 31 rotates counterclockwise, its sequence control pin 62 moves from the bottom end toward the upper end of the sequence control slot 64 in the base link 25. Once the sequence control pin 62 contacts the upper end of the sequence control slot 64, the clockwise rotation of the backrest link 66 and all resulting movement is halted and the chair 10 is in the fully reclined position as shown in FIG. 4. As the seat link 24 moves upward the front seat mounting link 36 and the footrest linkage 22 also move upward in a fixed relation to the seat link 24. In addition, as the first seat support link 30 rotates clockwise at its one end with respect to base link 25, link 30 also rotates clockwise at its other end around pivot connection 40 with respect to the front seat mounting link 36. Likewise, the lever arm 44 on the other end of the first seat support link 30 also rotates clockwise around pivot connection 40, which in turn causes the pin 140 fixed on the end of the lever arm 44 to rotate away from the pin 139 fixed to the footrest operating link 109, thereby stretching spring 138 and producing a positive bias resistance against movement of the chair from the TV to the fully reclined position. Therefore, in order to maintain the chair 10 in the fully reclined position, the positive bias produced by stretching spring 138 is overcome with the pressure exerted by the user's body weight against the backrest 13.

To return the chair 10 to the TV position from the fully reclined position, the user's body weight is removed from the backrest 13 and redistributed toward the front of the chair 10. The user's now redistributed body weight provides a downward force to move the seat link 24 down toward the base link 25 until stop pin 46 engages stop surface 47 and sequence control pin 62 contacts the bottom of the slot 64 and the TV position is reached. With the back pressure removed from the backrest 13, the positive bias provided by the stretched spring 138 aids the return to the TV position by pulling the pins 139 and 140 closer together.

It should be noted that if downward and rearward foot pressure is applied on the footrest 14 to retract the footrest linkage 22 while the chair 10 is in the fully reclined position without removing the back pressure as described above from the backrest 13, the chair 10 will move directly to the normal seating position. Retraction of the footrest linkage 22 causes a reversal of the linkage movements previously described, and in particular the seat link 24 to move forward which in turn pulls the backrest link 66 forward. The forward motion of the backrest 66 causes the backrest control link 67 to rotate counterclockwise around pivot connection 73 with respect to base link 25. With the separation between the first stop pin 78 on the backrest link 66 and the nose portion 81 on the backrest control link 67 being reduced, as previously described, the counterclockwise rotation of the backrest control link 67 causes the nose portion 81 to engage the stop pin 78 shortly after retraction of the footrest 14 has begun. Once the nose portion 81 of the backrest control link 67 engages the first stop pin 78 on the backrest link 66, the additional counterclockwise rotation of the backrest control link 67 resulting from the continued retraction of the footrest linkage 22 causes the backrest link 66 to move the backrest 13 from the full recline position toward the generally upright seating position. When the footrest 14 is moved to the fully retracted closed position and the footrest linkage 22 is fully retracted, the chair is in the normal seating position. As previously noted, the performance of this maneuver on the prior three-way reclining chair, having a mechanism manufactured by the assignee of this invention identified as Model No. 8338, could result in the linkage mechanism locking up before the normal seating position was reached.

While this invention has been described with reference to only one preferred embodiment, persons skilled in the art to which this invention pertains will appreciate numerous changes and modifications which may be made without departing from the spirit of this invention. Therefore, it is intended that the invention not be limited to the particular embodiment disclosed, but that the invention will include all embodiments falling within the scope of the following appended claims.

What is claimed is:

1. A three-way reclining chair comprising:

a stationary base, a relatively moveable seat, a backrest, a footrest, and mounted on each side of said chair;

seat linkage means including a seat link mounting said seat for movement relative to said base between a normal seating position, a rearwardly shifted TV position, and a raised full recline position;

backrest linkage means including a backrest link pivotally connected to said seat link, said backrest linkage means mounting said backrest for movement relative to said seat between a generally upright seating position and a full recline position where said backrest extends at an incline relative to said seat;

footrest linkage means connected to said seat link and mounting said footrest for movement between a fully retracted closed position adjacent said seat and a fully extended open position projected forwardly from said seat; and spring biasing means comprising a single spring interconnecting said footrest linkage means and said seat linkage means, said spring biasing means being operable to positively (a) bias said footrest to remain in said fully retracted closed position with the footrest positioned adjacent the seat, and (b) bias said footrest to remain in said fully extended open position, while still allowing said footrest to be moved between said fully extended open position and said fully retracted closed position by overcoming the bias of said spring wherein said seat linkage means includes a base link and a first seat support link having one end operatively connected with said base link and its other end operatively connected with said seat link by means of a front seat mounting link, said first seat support link having an arm projecting upwardly from its said other end, and said single spring comprises a coil spring having one end connected to said arm of said seat support link and its other end connected to said footrest linkage means.

2. The reclining chair of claim 1 wherein said biasing means operates to assist in moving said footrest from a partially extended position to said fully extended open position, 3. The reclining chair of claim 1 wherein said biasing means positively biases said footrest to remain in said fully retracted closed position with sufficient force to enable said backrest to remain in said generally upright position when said chair is moved by pulling rearwardly on said backrest.

4. The reclining chair of claim 1 wherein said footrest linkage means comprises a scissors linkage, said scissors linkage includes a footrest operating link, said front seat mounting link being generally bell crank shaped and having a forwardly extending actuating arm, said actuating arm having an end pivotally connected by a pivotal connection to one end of said footrest operating link, and said coil spring having its said other end connected to said footrest operating link adjacent said pivotal connection between said actuating arm and said footrest operating link.

5. The reclining chair of claim 4 wherein said seat linkage means further includes a second seat support link, said second seat support link being pivotally connected intermediate its ends to said first seat support link, said second seat support link having a first end pivotally connected to said base link and a second end pivotally connected to a first end of a rear seat mounting link, and said rear seat mounting link having a second end pivotally connected to said seat link at a location near the rear of said seat link.

6. The reclining chair of claim 5 wherein said second seat support link has a sequence control pin extending therefrom and movable within a sequence control slot of said base link to control movement of said seat linkage means between TV and full recline positions.

7. The reclining chair of claim 6 wherein said seat linkage means further comprises a stop pin extending from said seat link and engageable with said rear seat mounting link to limit downward movement of said seat link in the TV and full recline positions.

8. A three-way reclining chair comprising:

a stationary base, a relatively movable seat, a backrest, a footrest, and mounted on each side of said chair;

a base link mounted to said stationary base;

seat linkage means including a seat link mounting said seat for movement relative to said base link between a normal seating position, an intermediate position, and a full recline position;

backrest linkage means including a backrest link pivotally supported upon said seat link and a backrest control link mounted at one end by a pivot connection to said backrest link and at its opposite end to said base link, said backrest linkage means mounting said backrest for movement relative to said seat between a generally upright seating position and a full recline position where said backrest extends at an incline relative to said seat;

footrest linkage means mounted upon said seat link and mounting said footrest for movement between a fully retracted closed position adjacent said seat and a fully extended open position projected forwardly from said seat; and first stop means disposed on said backrest link and spaced from said pivot connection between said backrest link and Said backrest control link for receiving a positive downward force from said backrest control link and thereby rotating said backrest link and returning said backrest to said upright seating position as the footrest is moved from the fully extended open position to the fully retracted closed position when the backrest is reclined.

9. The reclining chair of claim 8 wherein said backrest linkage means further includes a second stop means, said second stop means being operable between said seat link and said backrest link to prevent all movement of said backrest link when said seat is in said normal seating position with said footrest in said fully retracted closed position.

10. The reclining chair of claim 9 wherein said first stop means comprises a pin extending from said backrest link and engageable with a nose portion of said backrest control link.

11. The reclining chair of claim 10 wherein said second stop means comprises a pin extending from said backrest link and engageable with a nose portion of said seat link.

12. The reclining chair of claim 8 further including spring biasing means comprising a single spring interconnecting said footrest linkage means and said seat linkage means, said spring biasing means being operable to positively (a) bias said footrest to remain in said fully retracted closed position with the footrest positioned adjacent the seat, and (b) bias said footrest to remain in said fully extended open position, while still allowing said footrest to be moved between said fully extended open position and said fully retracted closed position by overcoming the bias of said spring.

13. The reclining chair of claim 12 wherein said biasing means operates to assist in moving said footrest from a partially extended position to said fully extended open position.

14. The reclining chair of claim 12 wherein said biasing means positively biases said footrest to remain in said fully retracted closed position with sufficient force to enable said backrest to remain in said generally upright position when said chair is moved by pulling rearwardly on said backrest.

15. The reclining chair of claim 12 wherein said seat linkage means includes a base link and a first seat support link having one end operatively connected with said base link and its other end operatively connected with said seat link by means of a front seat mounting link, said first seat support link having an arm projecting upwardly from its said other end, and said single spring comprising a coil spring having one end connected to said arm of said seat support link and its other end connected to said footrest linkage means.

16. The reclining chair of claim 15 wherein said footrest linkage means comprises a scissors linkage, said scissors linkage includes a footrest operating link, said front seat mounting link being generally bell crank shaped and having a forwardly extending actuating arm, said actuating arm having an end pivotally connected by a pivotal connection to one end of said footrest operating link, and said coil spring having its said other end connected to said footrest operating link adjacent said pivotal connection between said actuating arm and said footrest operating link.

17. The reclining chair of claim 16 wherein said seat linkage means further includes a second seat support link, said second seat support link being pivotally connected intermediate its ends to said first seat support link, said second seat support link having a first end pivotally connected to said base link and a second end pivotally connected to a first end of a rear seat mounting link, and said rear seat mounting link having a second end pivotally connected to said seat link at a location near the rear of said seat link.

18. The reclining chair of claim 17 wherein said second seat support link has a sequence control pin extending therefrom and movable within a sequence control slot of said base link to control movement of said seat linkage means between TV and full recline positions.

19. The reclining chair of claim 18 wherein said seat linkage means further comprises a stop pin extending from said seat link and engageable with said rear seat mounting link to limit downward movement of said seat link in the TV and full recline positions.

20. A three-way reclining chair comprising:

a stationary base and a relatively moveable seat, backrest and footrest;

a stationary base link directly mounted to said stationary base;

seat linkage means including a seat link mounting said seat for movement relative to said base between a normal seating position, a rearwardly shifted TV position, and a raised full recline position;

backrest linkage means including a backrest link pivotally connected directly to said seat link, and a backrest control link pivotally connected between said base link and said backrest link, said backrest linkage means mounting said backrest for movement relative to said seat between a generally upright seating position and a full recline position where said backrest extends at an incline relative to said seat;

footrest linkage means mounting said footrest for movement between a fully retracted closed position adjacent said seat and a fully extended open position projected forwardly from said seat; and sequencing stop means within said backrest linkage means including a pin on said backrest link engageable with a stop surface of said backrest control link for preventing said seat from moving directly from said normal seating position to a raised position while said footrest is in said fully retracted closed position.

21. The reclining chair of claim 20 wherein said sequencing stop means further includes a second stop pin on said backrest link engageable with a stop surface of said seat link.

* * * * *